United States Patent [19]

Itoh

[11] 4,289,278

[45] Sep. 15, 1981

[54] POWDER ELECTRO-CHARGING DEVICE AND ELECTROSTATIC POWDER PAINTING DEVICE

[75] Inventor: Tsutomu Itoh, Tokyo, Japan

[73] Assignee: Onoda Cement Co., Ltd., Yamaguchi, Japan

[21] Appl. No.: 68,677

[22] Filed: Aug. 22, 1979

[30] Foreign Application Priority Data

Sep. 1, 1978 [JP] Japan ..... 53-107336

[51] Int. Cl.[3] ..... B05B 5/02

[52] U.S. Cl. ..... 239/706; 239/105; 361/227

[58] Field of Search ..... 239/690–708, 239/3, 105; 361/218, 226, 227

[56] References Cited

U.S. PATENT DOCUMENTS

| | | | |
|---|---|---|---|
| 3,698,635 | 10/1972 | Sickles | 239/3 |
| 4,011,991 | 3/1977 | Masuda | 361/227 X |
| 4,039,145 | 8/1977 | Felici et al. | 239/706 |

FOREIGN PATENT DOCUMENTS

| | | | |
|---|---|---|---|
| 990149 | 4/1965 | United Kingdom | 239/698 |

*Primary Examiner*—Robert W. Saifer

*Attorney, Agent, or Firm*—Price, Heneveld, Huizenga & Cooper

[57] ABSTRACT

An electrostatic powder painting device provided with an improved powder electro-charging device is described herein, which painting device comprises a duct for conveying powder suspended in gas, an electrode chamber communicating with a slit formed along the entire inner circumference of said duct, a ring electrode disposed within said electrode chamber and having a substantially large radius of curvature in cross-section, a corona discharge electrode disposed at the center of said duct, gas introduction means into said duct through said slit, a voltage source for applying a voltage between said corona discharge electrode and said ring electrode, and means disposed in the proximity of the outlet end of said duct for regulating an ejection pattern of a powder cloud, whereby said painting device can maintain an highly excellent charging performance over a long period of time when the powder conveyed by the gas is charged with unipolar electric charge and also the most important performance of an electrostatic powder gun, i.e., a greatly enhanced transfer efficiency, penetration capability and wrapping-around capability for carrying out electrostatic powder painting.

31 Claims, 21 Drawing Figures

POWDER ELECTRO-CHARGING DEVICE AND ELECTROSTATIC POWDER PAINTING DEVICE

The present invention relates to a powder electro-charging device for giving a unipolar electric charge to powder conveyed by gas and which is available for electrostatic powder painting or the like and which device is compact, simple in structure and excellent in performance. The invention also relates to an electrostatic powder painting device which is constructed for use in said powder charging device and which is excellent in transfer efficiency, penetration capability, wrapping-around capability, powder painting capability such as for an insulator, etc.

Figure 15:
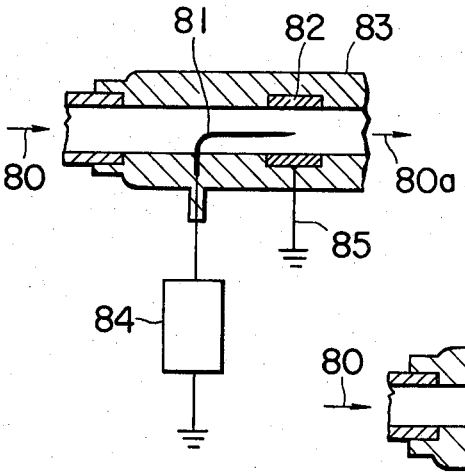
FIG. 15 PRIOR ART

Heretofore it has been well known, in principle, that in order to charge powder particles such as powder paint conveyed by gas with a unipolar electric charge for the purpose of electrostatic powder painting or the like, it is only necessary to dispose an annular electrode 82 on an inner surface of a tubular wall 83, forming a passageway of a gas/powder mixed flow 80, and to dispose a needle electrode 81 at the center of the annular electrode 82 as opposed thereto and to apply a D.C. high voltage between these electrodes from a voltage source 84 for charging the powder with a unipolar ion current from the needle electrode having the same polarity as the voltage source 84, as shown in FIG. 15.

However, when the aforementioned method is applied to industrial equipment to be operated continuously, then as the operation time accumulates micro-fine particles of powder accumulate on the surface of the annular electrode and form an insulator layer. Consequently the current from the needle electrode 81 to the annular electrode 82 is impeded by this insulating layer. At the same time, due to inverse ionization, a current having an opposite polarity generated within the insulating layer begins to flow in the opposite direction from the surface of the annular electrode 82 towards the acicular electrode 81, so that the charge acquired by the powder due to the unipolar current from the needle electrode 81 is offset by this current of opposite polarity. Therefore, it is impossible to construct industrial equipment which is required to operate continuously over a long period by employing the basic construction illustrated in FIG. 15.

With regard to the measures for resolving the above-mentioned problem, various methods have been proposed in the prior art, and these methods are generally classified into the following two kinds of methods.

Figure 16:
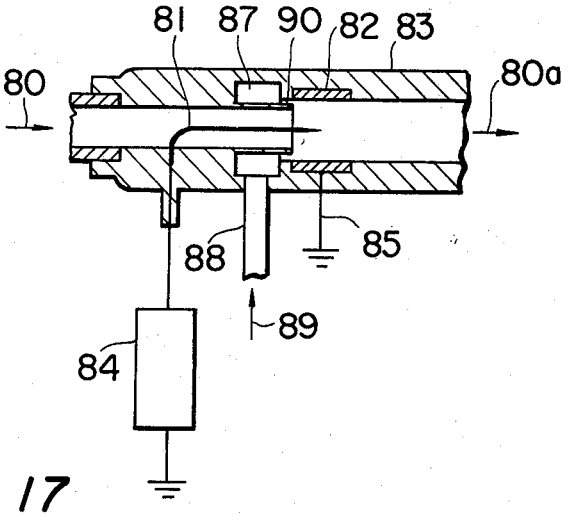
FIG. 16 PRIOR ART

The first method is one in which clean gas 89, not containing powder particles, is introduced into an annular chamber 87 through a gas supply pipe 88, and a clean gas flow layer is always formed on the surface of the annular electrode 82 by ejecting this gas at a high speed through a ring-shaped nozzle 90 provided on the downstream side of the annular chamber 87 as shown in FIG. 16, whereby accumulation of powder particles on the surface of the annular electrode 82 can be prevented. It is to be noted that reference numeral 85 designates a grounding wire. In FIGS. 15 to 21 which show the prior art devices, component parts achieving the same functions are designated by like reference numerals. However, in the above-described first method representatively illustrated in FIG. 16, there exists a serious shortcoming in that the flow rate of the gas containing no powder particle ejected through the ring-shaped ejection nozzle 90 becomes considerably larger, resulting in an extremely high speed of the powder containing gas flow at an outlet of the powder charging device as indicated by arrow 80*a*, and, in the case where this powder electro-charging device is used as an electrostatic powder painting gun, the ejection speed at a tip end of the gun becomes very fast. Thus, as a practical matter for the objects for which the electrostatic powder painting gun are available are extremely limited. Also, practically, it is very difficult to achieve the objective of preventing accumulation of micro-fine powder particles on the surface of the annular electrode 82 over a long period of time through the aforementioned method.

Figure 18:
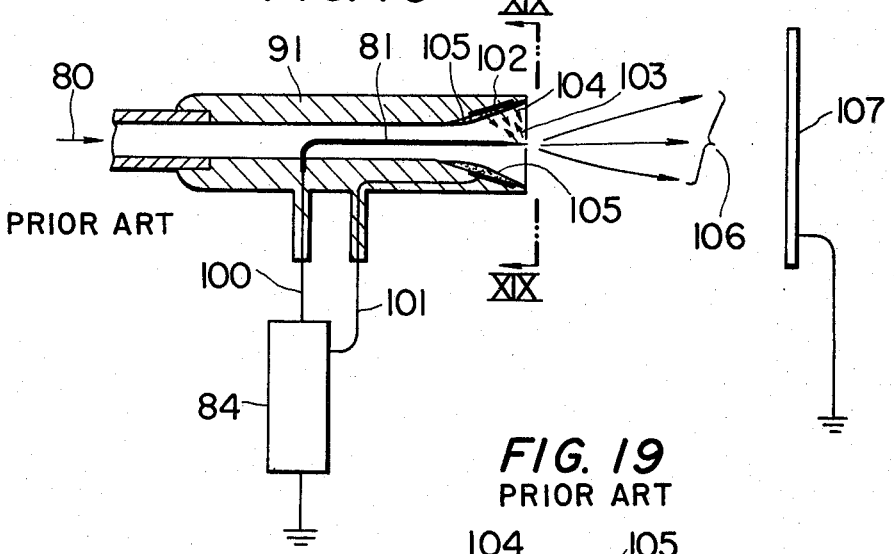
Figure 19:
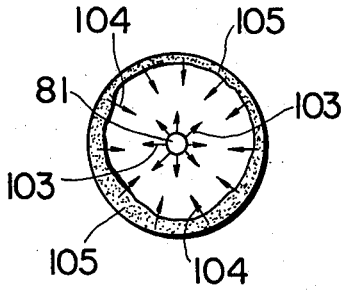
FIG. 19 PRIOR ART

In addition, it has been proposed that the electrode pair shown in FIG. 15 be displaced to a powder ejection port as shown in FIGS. 18 and 19, in which an opposite electrode 102, having a large radius of curvature in cross-section, is disposed inside of a powder ejection port at the tip end of a gun head 91 or in its proximity, as opposed to the tip end of a needle electrode 81, the highest voltage is applied to the acicular electrode 81 from a voltage source 84 through wiring 100, and a somewhat lower voltage than the highest voltage is applied to the opposite electrode 102 through wiring 101. In this way enhancement of the transfer efficiency of the electrostatic powder painting gun has been tried. However, in such a modified arrangement, since the flow speed of the powder stream is normally unable to be raised so high at the tip end of the powder ejection port serving as a gun head, even if it should be attempted to create a unipolar current 103 flow across the powder stream ejected from the gun head, strongly charged particles 105 of powder paint would immediately accumulate on the surface of the opposite electrode 102. Thus, due to inverse ionization generated within the accumulated particles, a current 104 of opposite polarity will flow out strongly towards the needle electrode 81, which current would offset the unipolar charging effect caused by the current 103. Hence immediately it would become impossible to give an electric charge to the powder within such a region. Accordingly, in such a case, the provision of the opposite electrode 102 as opposed to the tip end of the needle electrode 81, would not play any effective role and, thus cannot achieve the desired objective. This is solely due to the fact that at the ejection port of a high gun the ejection speed of the powder stream cannot be chosen, and therefore, it is quite impossible to enhance the transfer efficiency of a gun head by means of the opposite electrode 102 provided on the inside of the ejection port. In this case, however, since a monopolar current flowing from the tip end of the acicular electrode towards the body 107 to be painted, normally exists, in some cases the performance of the gun head is not significantly lowered as is the case with the gun head shown in FIGS. 15 and 16, but the condition of the paint powder deposited on the body to be painted is liable to become unstable, and in any event, no positive advantage can be obtained by providing the opposite electrode 102 in the proximity of the ejection port of the gun.

Figure 17:
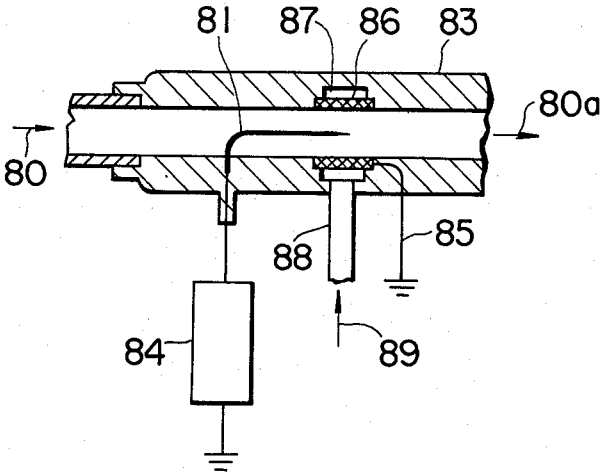
FIG. 17 PRIOR ART

The second method for preventing accumulation and adhesion of micro-fine powder particles on the surface of the annular electrode 82 is a method in which the annular electrode 86 is made of porous material, clean gas 89, not containing powder particles, is introduced through a piping 88 into an annular chamber 87 formed on the backside of the conductive porous electrode 86, and by ejecting this gas through the porous electrode 86, the accumulation and adhesion of the micro-fine powder particles on the surface of the annular electrode 86 is prevented, as shown in FIG. 17. However, in this second method, in order to prevent accumulation of powder particles on the surface of the electrode 86 it is necessary to eject an amount of gas that is at least one-half of, normally almost equal to the amount of gas required for conveying the powder. This results in an extremely enhanced flow speed of the powder conveying gas at the outlet of the powder charging device, as shown by arrow 80'. Therefore, this second method has an extremely limited applicable range and, thus lacks practicability similarly to the first method shown in FIG. 16. Moreover, although the device can withstand use for periods of several tens of minutes to several hours by employing this method, it is practically impossible to obtain a device which can withstand continuous use for several tens of minutes to several hundreds of hours.

In the method for preventing accumulation and adhesion of micro-fine powder particles on the surface of the annular electrode by making use of a large amount of auxiliary gas flow as shown in FIGS. 16 and 17, generally the gas flow speed at the outlet of the powder charging device becomes very large, and thereby a carrier gas speed within an apparatus connected to the downstream side of the device becomes excessively large, so that it is liable to become a cause for generating the problems of adhesion of resin or the like. Furthermore, the method has a disadvantage that it is difficult to maintain stability of performance of the device over a long period of time. Also, according to the method it is very difficult to utilize the powder charging devices in multiple stages in series because of the need for a large quantity of auxiliary gas.

Figure 20:
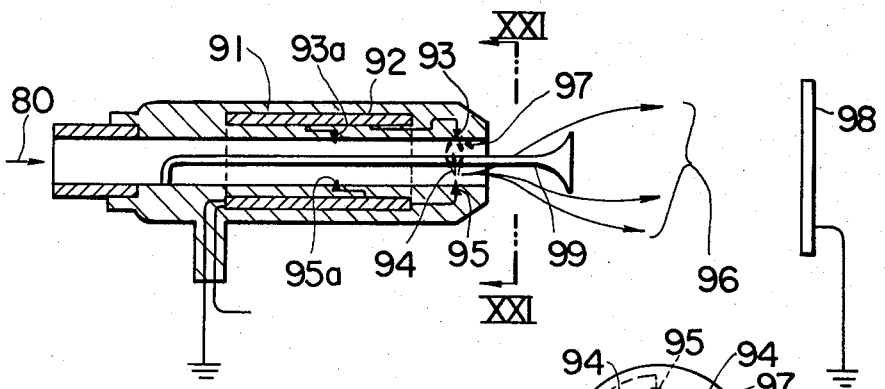
FIG. 20 PRIOR ART
Figure 21:
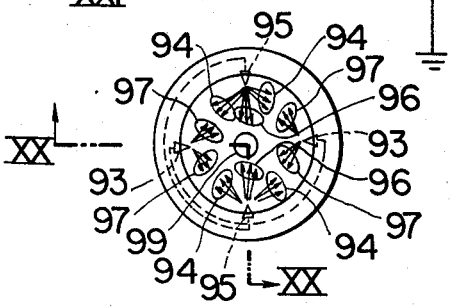
FIG. 21 PRIOR ART

Next, as one example of an electrostatic powder painting gun in the prior art which is intended to charge powder by providing a large number of electrodes on an inner wall surface of an insulative pipe and generating corona discharge between these electrodes, an electrostatic powder painting device is illustrated in FIGS. 20 and 21.

In this type of electrostatic powder gun, on an inner wall surface of the tip end portion or an inner portion of the gun main body, consisting of an insulator cylinder, two or several pairs of acicular electrodes are disposed to project therefrom so that a potential difference of several thousand volts may be applied between adjacent ones of the electrodes 93, 95, **93*a* and 95*a*. To one electrode in each electrode pair at the outlet end is applied the highest voltage supplied by a D.C. high voltage source 92 assembled in the gun main body, so that a small spark discharge may be effected continuously between the electrodes in each pair through a protective resistor, not shown, and thereby powder conveyed by a gas/powder mixed phase stream 80 can be applied on a body 98** to be painted. In this type of electrostatic powder gun, while it has been generally believed that a corona discharge current existing between adjacent electrodes has the effect of charging the powder passing through the interior of the insulator cylinder, this is not correct. The discharge generated between adjacent electrodes in this type of gun is needle-to-needle, bipolar corona discharge as is well known in electro-discharge engineering, and hence, powder passing across the space separating the needle electrodes merely has its electric charge removed. Therefore, and the bipolar corona discharge cannot achieve a charging effect. Only when these electrode pairs are positioned at the end of the insulator cylinder, opposed to the body to be painted and, as a whole, the electrode pairs have potential differences with respect to the body to be painted, is a charging effect present predominantly in the space separating the end of the cylinder from the body to be painted.

Now the aforementioned effect will be described in greater detail.

Between a pair of electrodes 93 and 95, from the electrode 95, to which a higher voltage is applied, a current of the same polarity as a voltage source 92 flows out (for instance, if the voltage source 92 is a voltage source for generating a negative high voltage, a negative ion current) towards the electrode 93 as shown by arrows 94, whereas from the electrode 93 flows out a positive ion current 97 of opposite polarity to the current 94 towards the electrode 95. As a result of the crossing of positive and negative strong ion currents of different polarities within such a narrow space, powder particles passing through the space between the needle tip electrodes 93 and 95 will have their electric charge sufficiently removed, and therefore, the powder particles cannot be charged by the ion currents flowing directly between these electrodes 93 and 95.

The mechanism of effecting charging of the powder particles by means of the aforementioned type of gun is such that due to a D.C. electric field existing between the electrode 95 at the tip end of the gun and a body 98 to be painted, a very small part of the negative ion current flowing out of the electrode 95 towards the electrode 93 would flow towards the body 98 to be painted as shown by arrows 96. Hence only the particles ejected externally from the tip end of the gun are charged by this ion current that is drawn out of the gun and flows in parallel to the powder flow. Accordingly, even if additional electrode pairs **93*a* and 95*a*** are further disposed at the more inwardly existing portion of the insulator cylinder, these electrode pairs will serve merely as charge-removing means for the powder and will contribute little to charging of the powder. Therefore, these electrodes pairs cannot be used as powder charging means. Accordingly, such type of electrostatic powder painting gun is one kind of conventional powder gun which comprises a corona discharge electrode at the powder ejection end facing a body to be painted. It is impossible for such a gun to achieve the objects of providing an industrial device for unipolarly charging powder within a duct, enhancing the transfer efficiency of an electrostatic powder painting gun, and providing a novel type of electrostatic powder painting gun having a highly excellent penetration capability, an enhanced wrapping-round capability and a powder painting capability for an insulator as is the case with the charging device according to the present invention.

Therefore, it is one object of the present invention to provide a unipolar powder charging device having a simple structure which has extremely reduced consumption of gas for preventing accumulation of micro-fine powder on the surface of the opposed ring electrode, which is available in multiple stages, in series through the same duct and which can maintain a highly excellent performance, as compared to the well-known powder charging devices in the prior art as explained above.

Another object of the present invention is to provide a novel electrostatic powder painting device having highly excellent general-purpose functions which are really ideal for an electrostatic powder painting gun such as transfer efficiency, penetration capability and wrapping-around capability, by making use of the aforementioned novel powder charging device.

According to one feature of the present invention, there is provided a powder charging device comprising a duct for conveying powder suspended in gas, an annular electrode chamber positioned outside of said duct and communicating with said duct through a slit extending substantially along the entire inner circumference of said duct; a ring electrode disposed within said electrode chamber and having a substantially large radius of curvature in cross-section, a corona discharge electrode disposed at the center of said duct, means for introducing gas into said duct through said slit and means for applying a voltage between said respective electrodes so as to generate a unipolar corona discharge from said corona discharge electrode towards said ring electrode.

According to another feature of the present invention, there is provided an electrostatic powder painting device which comprises the above-featured powder charging device, and means for regulating the ejection pattern of a powder cloud and electrode means for establishing an electric field for driving charged powder towards a body to be painted both disposed in the proximity of the outlet end of the duct for conveying said powder.

Figure 1:
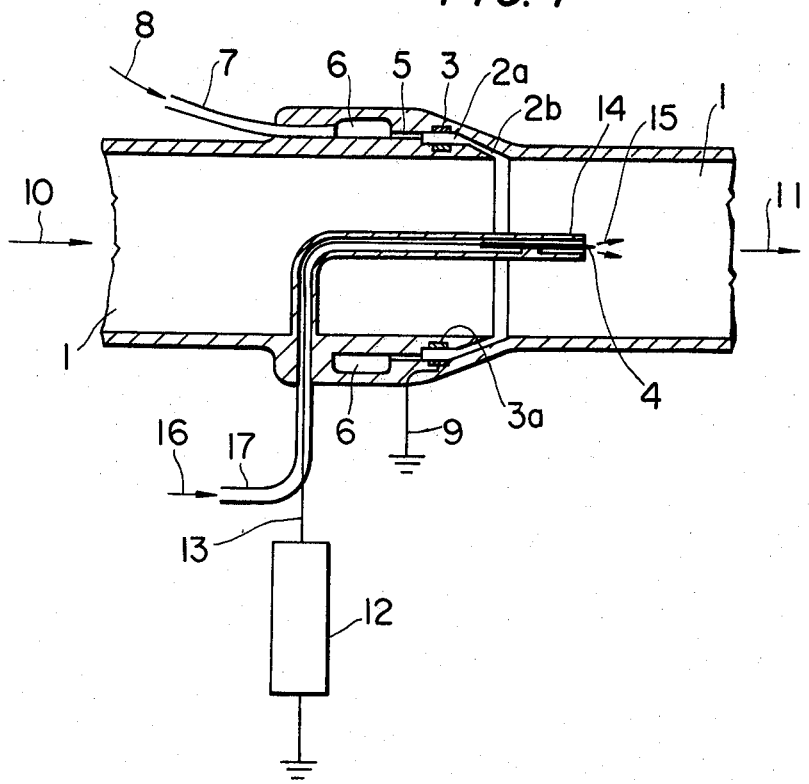
Figure 3:
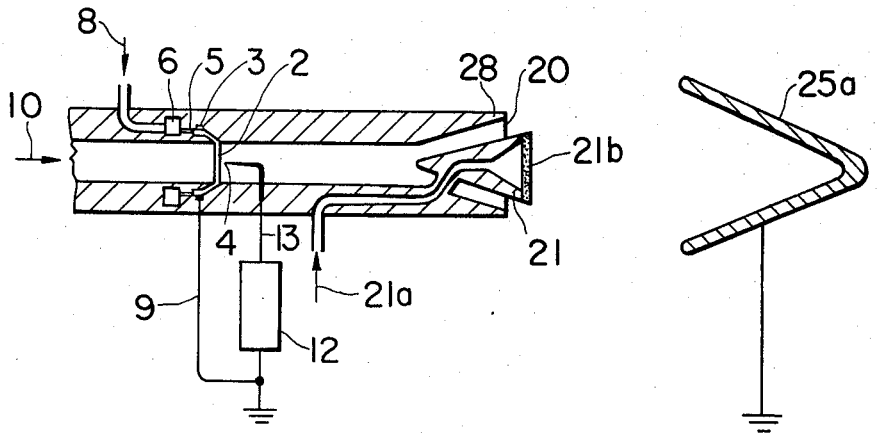
Figure 2:
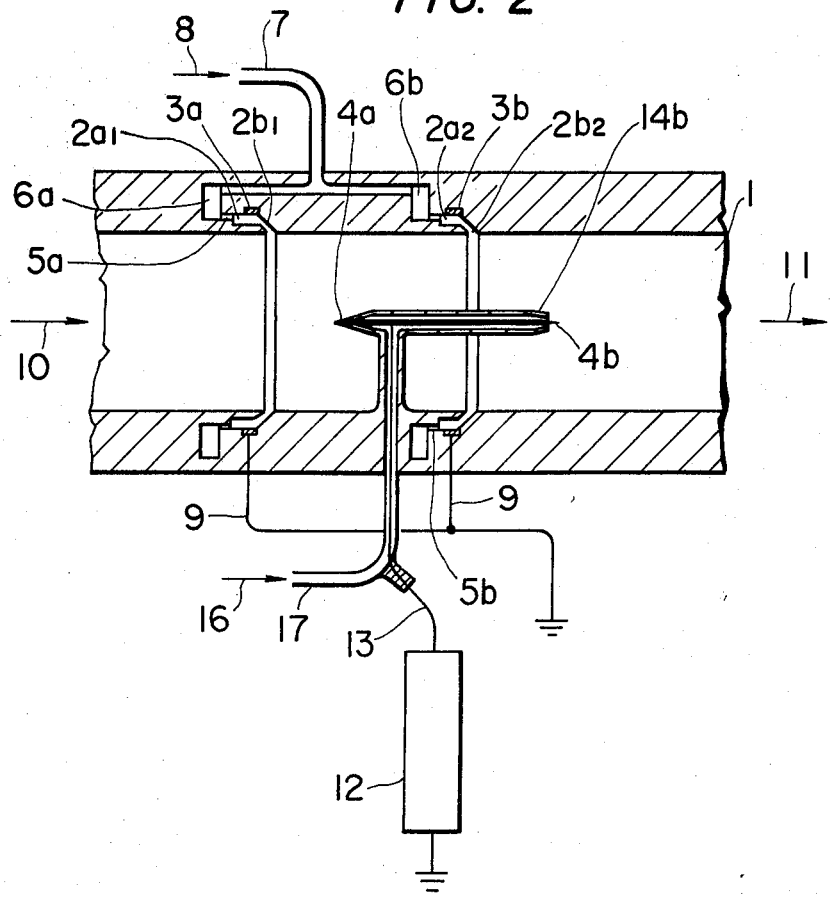

The above-mentioned and other features and objects of the present invention will become more apparent by reference to the following description of its preferred embodiments taken in conjunction with the accompanying drawings, wherein:

FIG. 1 is a longitudinal cross-section view of one preferred embodiment of a powder charging device according to the present invention, FIG. 2 is a longitudinal cross-section view of another preferred embodiment of a powder charging device according to the present invention, FIG. 3 is a longitudinal cross-section view of one preferred embodiment of an electrostatic powder painting device according to the present invention, FIGS. 4 to 10 are longitudinal cross-section views showing other preferred embodiments of the present invention, FIGS. 11 to 14 are schematic circuit diagrams of means for varying voltages to the electrodes in the preferred embodiments of the present invention, and FIGS. 15 to 21 are cross-section views showing known devices in the prior art, FIG. 19 being a transverse cross-section view taken along line XIX—XIX in FIG. 18, and FIG. 21 being a transverse cross-section view taken along line XXI—XXI in FIG. 20.

Referring now to FIG. 1 of the drawings, a unipolar powder charging device according to the present invention comprises a duct 1 for conveying powder as suspended in gas, an annular electrode chamber 2*a* positioned outside of the duct 1 and communicating with the duct 1 through a slit 2*b* extending substantially along the entire inner circumference of the duct 1, a ring electrode 3 within this electrode chamber 2*a* and having a substantially large radius of curvature in cross-section, a corona discharge electrode 4 disposed at the center of the duct 1, and a gas supply pipe 7, an annular chamber 6 and a gas guide passageway 5 disposed so that introduction of gas may be effected uniformly from the annular chamber 6 to the electrode chamber 2*a*, which jointly form means for introducing gas into the duct 1 through the slit 2*a*. Furthermore, in order to apply a voltage between these electrodes so as to generate a unipolar corona discharge from the corona discharge electrode 4 towards the ring electrode 3, an appropriate voltage is applied to the corona discharge electrode 4 via a lead wire 13, while the ring electrode 3 is grounded through a lead wire 9. In addition, in the device shown in FIG. 1, in order to prevent the powder passing through the duct 1 from adhering to the tip end of the corona discharge electrode 4 and resulting in change of its discharge characteristics, a clean gas flow, as indicated by arrow 16, is introduced via a piping 17 and through a sheath 14 formed by a conventional insulator so that a gas flow 15, ejecting around the corona discharge electrode 4 at a high speed may be established.

In the unipolar powder charging device according to the present invention as described above, since a unipolar ion current issuing from the tip end of the corona discharge electrode 4 due to the voltage applied between the corona discharge electrode 4 and the strip electrode positively extends across the entire circumference of the duct 1 and reaches the ring electrode 3 through the slit 2*b*, the powder suspended in the gas introduced into the duct 1, i.e., the gas/powder, mixed-phase stream 10 is reliably charged by intersecting with the unipolar ion current layer which extends across the entire circumference of the cross-section of the duct 1. The resulting charged powder flow goes out of the duct 1 as shown by arrow 11. In this case, since the annular electrode 3 is positioned entirely outside of the duct 1 while it is communicated with the duct 1 via the slit 2*b*, clean gas supplied in the direction shown by arrow 8 being ejected into the duct through the slit 2*b*, and it is possible to reduce the width of the slit 2*b* to a very small width, the amount of the gas blown into the duct 1 through the slit 2*b* can be reduced to a very small quantity of about ten to several liters per minute, even if the flow speed of the gas within the slit 2*b* is chosen at a value that can fully prevent adhesion of the powder onto the ring electrode. Accordingly, the flow rate of the gas flow within the duct 1 is almost not affected by this additional gas flow. Nevertheless, the charged powder would not flow inversely towards the electrode 3 through the slit 2*b* because the flow speed of the gas stream through the slit 2*b* is very fast. Whereas, the traveling speed of ions within the slit 2*b* is normally sufficiently fast and directed in the opposite direction with respect to the flow speed of the gas flow, and hence, even if the gas is ejected through the slit 2*b* at a speed of about 30 m/sed., the ion current can flow in the opposite direction to the gas flow and can easily reach the strip electrode 3.

It is to be noted that since it is important for the slit 2*b* to have a uniform thickness over the entire circumference, about three spacers are disposed in the slit 2*b* to realize such a uniform thickness of the slit 2*b*. In this case, it is desirable to keep the width of the spacers as small as possible so that the slit 2*b* may be formed substantially along the entire circumference.

As described above, contamination of the surface of the ring electrode 3 by the powder particles passing through the duct 1 can be very surely prevented.

The unipolar powder charging device illustrated in FIG. 1 can maintain its highly excellent performance over a very long period of time. Moreover, the clean gas flow introduced in the direction shown by arrow 8 for maintaining cleanliness of the surface of the electrode 3 can operate effectively with a smaller flow rate than the conventional type of electrodes as illustrated in FIGS. 16 and 17 and briefly described above. With regard to the ring electrode 3, it is required that the electrode 3 have a substantially larger radius of curvature as described above so that a discharge current may not flow from the ring electrode 3 towards the corona discharge electrode 4.

Normally, a chamfered annular strip (ring) electrode 3 could be embedded in the wall of the annular electrode chamber *2a*, made of an insulating material, as shown in FIG. 1, but the invention is, as a matter of course, not limited to such arrangement. Also, the corona discharge electrode 4 is not limited to a needle shape electrode as shown in FIG. 1, a different shape of electrode such as one which is wire-shaped or knife edge-shaped could be employed, depending upon the necessity what is necessary.

In addition, the present invention is not limited to the embodiment in which the strip electrode 3 is provided in the outside wall of the electrode chamber *2a* with respect to the duct 1 as shown in FIG. 1, the strip electrode could be provided in the inside wall of the electrode chamber *2a* on the side of the duct 1 as shown at *3a*. Moreover, the electrode chamber *2a* and slit *2b* need not be provided as two separate portions as shown in FIG. 1, a part of the slit could be utilized as an electrode chamber.

With regard to the gas guide passageway 5, a series of parallel orifices such as orifices disposed normally in an annular array for providing an appropriate fluid resistance could be utilized such that air introduced into the annular chamber 6 may flow in uniform distribution over the entire surface area of the strip electrode 3. The direction of these orifices need not be at right angles to the strip electrode 3, but in some cases could be formed as a group of orifices which are inclined with respect to the axis of the annular chamber 6 so as to make the gas stream have a circumferential direction such that the ejected gas stream may have a swirl component flowing at a high speed along the surface of the electrode 3.

Although the ring electrode 3 could be normally made of metallic material having a stainless property, in the case where powder has moved inversely from the duct 1 towards the ring electrode 3 and has adhered to the surface of the electrode 3 due to an improper sequence of operations or the like, if an ion current is made to flow between the ring electrode 3 and the corona discharge electrode 4 while leaving the adhered powder intact, then melting and adhesion of the powder will occur on the surface of the electrode 3. In order to avoid the above disadvantage, the ring electrode 3 is composed of an appropriate non-adhering conductive material prepared by mixing an appropriate conductive material such as carbon powder or the like with a non-adhering resin such as, for example, a fluorine resin, polyolefin resin, nylon resin, polypropylene resin, etc. Thereby, even if the aforementioned type of accident should occur with melting and adhesion of powder on the surface of the ring electrode the resulted degradation of the performance of the device could be prevented. In this case, especially conductive fluorine resin provides an excellent performance and has a good versatility, but the material should not be limited to this non-adhering conductive material and other non-adhering conductive materials could be used satisfactorily, depending upon the kind of powder to be charged. The selection of the material for the ring electrode 3 is very important for constructing a versatile, powder charging device, and forms an essential part of the present invention.

In the preferred embodiment shown in FIG. 1, the corona discharge electrode, 4 is disposed in such manner that the tip end of the electrode where corona discharge arises, may be located on the downstream side with respect to the gas/powder mixed-phase flow 10 within the duct 1. In the case of treating chemically stable powder, sometimes the gas flow for preventing adhesion of the powder onto the tip end of the corona discharge electrode 4 as shown by arrows 15 is unnecessary. However, in the case of charging the conventional thermo-setting, resin powder paint, if the tip end of the corona discharge electrode 4 is positioned on the downstream side with respect to the gas/powder mixed-phase flow 10, it is desirable to provide a sheath 14 around the tip end of the corona discharge electrode 4 so that the tip end may be surrounded by a gas flow not containing the resin powder for preventing adhesion of the resin powder onto the tip end as shown by arrows 15. The sheath 14 is desirably made of an insulator material. Accordingly, the corona discharge electrode 4, according to the present invention, is disposed correctly at the center of the duct 1, independently of the wall of the duct 1, and is kept insulated from the inner wall surface of the duct 1.

Upon operation of the unipolar powder charging device as illustrated in FIG. 1, it is desirable to control the operation so that the gas introduced into the powder conveying duct 1 may preliminarily start to flow through the slit *2b* before the gas/powder mixed-phase flow 10 flows through the duct 1. Accordingly, the sequence of operations upon starting the device preferably should be such that first gas indicated by arrow 8 is introduced into the gas supply pipe 7 and at the same time or subsequently gas indicated by arrow 16 is introduced into the piping 17. After it is certain that these gases have begun to flow, a voltage is applied between the strip electrode 3 and the corona discharge electrode 4 and finally the gas/powder mixed-phase flow 10 is passed through the duct 1. Furthermore, in this preferred embodiment, in the case where the powder charging device according to the present invention is used as one part of an electrostatic powder painting device, normally the gas/powder mixed-phase flow 10 is supplied intermittently, as synchronized with passage of a body to be painted across the outlet of the electrostatic powder painting device, and especially in the case where the device is used as a hand gun for touch-up, there occurs a condition where the powder temporarily does not pass through the duct 1 over a substantially long period of time. When the device is in such a temporary inactive condition or when the device is cleaned, sometimes the powder adhered in the proximity of the outlet on the farther downstream side of the duct 1 is flushed by a jet flow of pressurized air as actuated by an operater, and in such a case sometimes it may possibly occur that the adhered powder flows inversely through the duct 1 and adheres to the strip electrode 3 and the corona discharge electrode 4.

Therefore, as a provisional measure including the measure against the above-mentioned accident, it is desirable to make the gas introduced into the duct 1 through the slit *2a* always continue to flow during the period of time when there is a risk that the powder may be present within the duct 1, regardless of whether or not the powder flow is present during normal times, and this is also substantially true with respect to the gas 15 ejected around the tip end of the corona discharge electrode 4.

While a first method for maintaining stability of performance of the corona discharge electrode 4 over a long period of time is the method shown in FIG. 1 in which the tip end of the corona discharge electrode 4 is directed to the downstream side with respect to the direction of conveying the powder and clean gas is ejected around the tip end, a second method is known. The second method, shown in FIG. 2, is one in which the object of maintaining the performance of the corona discharge current effective for a long period of time is accomplished by directing the tip end of the acicular electrode 4 to the upstream side of the gas/powder mixed-phase flow. This is because the adhesion of the powder can be effectively prevented owing to the fact that the tip end of the corona discharge electrode 4 is exposed to the high-speed gas/powder mixed-phase flow 10.

A double stage type of monopolar powder charging device, according to the present invention, is illustrated in FIG. 2. In this type, the above-mentioned type of corona discharge electrode **4*a* and another corona discharge electrode 4*b* of the type shown in FIG. 1, having its tip end directed to the downstream side of the gas/-powder mixed-phase flow, are integrally combined and, by making use of the respective effects cooperatively, a further enhanced powder charging efficiency can be obtained with an extremely small-size device. More particularly, the corona discharge electrode 4*a* and the corona discharge electrode 4*b* consist of an upstream end and a downstream end, respectively, of a same conductor wire, and a common voltage is applied to this conductor wire from a voltage source 12 through a lead wire 13. The corona discharge electrode 4*a* on the upstream side is not provided with a gas stream discharge around the electrode, whereas around the corona discharge electrode 4*b* on the downstream side clean gas is discharged as indicated by arrow 16 through a pipe 17 and guided by an electrode sheath 14*b* so as to surround the tip end of the corona discharge electrode 4*a*. A strip electrode 3*b* opposed to the corona discharge electrode 4*b* is accommodated within an electrode chamber 2*a*2 similarly to the embodiment shown in FIG. 1, and this electrode chamber 2*a*2 communicates with the duct 1 through a slit 2*b*2 about the entire inner circumference of the duct 1. Accordingly, a unipolar ion current issuing from the corona discharge electrode 4*b* flows towards the ring electrode 3*b* through the slit 2*b*2 extending about the entire inner circumference of the duct 1, and as a result, the gas/powder mixed-phase flow 10 will always pass through an uninterrupted ion current layer formed across the duct 1 from the tip end of the corona discharge electrode 4*b* towards the ring electrode 3*b*, so that charging of the powder can be positively effected by the ion current. In this case, since clean gas indicated by arrow 8 is introduced into an annular chamber 6*b* through a gas supply pipe 7, and is ejected at a high speed through the slit 2*b*2 into the duct 1 while being shaped into a clean gas flow layer along the surface of the ring electrode 3*b* by a gas guide passageway 5*b*, the inverse flow of powder through the slit 2*b*2 from the duct 1 to accumulate on the surface of the strip electrode 3*b* can be totally prevented and thereby a monopolar ion current can be surely maintained between the pair of electrodes 4*b* and 3*b* in a stable manner over a long period of time. Moreover, since a unipolar ion current is similarly established from the tip end of the other corona discharge electrode 4*a* towards another ring electrode 3*a*, the powder passing through the duct 1 can be charged twice by these respective unipolar ion currents, and hence the powder is effectively charged at an extremely high efficiency. It is to be noted that in the above-described embodiment shown in FIG. 2, the construction and operation of an electrode chamber 2*a*1, a slit 2*b*1, a gas guide passageway 5*a*, an annular chamber 6*a*, etc. associated with the ring electrode 3*a* are exactly the same as those associated with the ring electrode 3*b* as described above. The powder charging device according to the present invention is characterized in that charging of powder can be achieved at a high efficiency with a small amount of gas to be used in a very compact device as will be seen from the embodiment shown in FIG. 2**.

The powder charging device according to the present invention can unipolarly charge resin powder such as conventional powder paint or the like, continuously and at a high efficiency over a long period of time, and hence the device is applicable to various purposes. The device shown in FIG. 3 is one example of such an application, in which a regulating cone 21 for an ejected pattern of a powder cloud that has been charged and ejected is disposed at the downstream end of a powder charging device according to the present invention, and at the same time an ejection end 28 of the cylindrical body of the duct is outwardly flared, so that highly electro-charged, powder particles may be ejected slowly. It is to be noted that reference numeral **25*a* designates a body to be painted having a V-shaped cross-section, which extends in a direction perpendicular to the plane of the drawing, which is grounded and which is disposed so as to be opposed to the pattern regulating cone at the ejection port. The surface of the ejected pattern regulating cone 21 facing the body to be painted is constructed of a porous member 21*b* for the purpose of preventing adhesion and accumulation of the powder on its surface. By ejecting clean gas, as indicated by arrow 21*a*, through this porous member 21*b*, the powder is prevented from accumulating on the surface of the cone 21 facing the body to be painted. In FIG. 3, with respect to the principal component parts of the powder charging device, those component parts having the same functions as those shown in FIGS. 1 and 2 are given like reference numerals. When employing the powder painting gun having the construction shown in FIG. 3, since there is not present a strong electric field extending from the gun towards the body to be painted, as is found in the case of the prior art electrostatic powder painting gun, the strongly electro-charged powder ejected from the ejection port 20 is mainly affected only by the ejected air jet flow, and hence, after it has fully entered into the narrow portion at the innermost bottom of the V-shaped cross-section of the body 25*a*** to be painted, it is electrostatically fixed on the body to be painted due to a strong space-charge electric field established by the electric charge carried by the powder itself. Accordingly, such type of gun can be utilized as an electrostatic powder painting gun having a very excellent penetration capability.

Thus, the present invention provides a novel type of electrostatic powder painting gun which can almost perfectly eliminate the well-known great disadvantage associated with the prior art electrostatic powder painting gun of the type in which a corona discharge pin is disposed at an ejection port and, by establishing a strong electric field between this corona discharge pin and a body to be painted, powder is charged in the region between the powder painting gun and the body to be painted—the "Faraday cage effect"—, that problem being that a recessed portion can hardly be painted by powder.

In the above-described novel type of electrostatic powder painting gun, the diameter of the duct forming a part of the powder charging device could be satisfactorily selected at about 10 mm which is the dimension employed in the conventional electrostatic powder painting gun. At the same time, the troubles caused by adhesion of powder particles to the surface of the opposed ring electrode 3 can be positively prevented, and also the troubles caused by adhesion of powder particles to the tip end of the needle corona discharge electrode 4 can be positively prohibited. In addition, the amount of gas introduced into the duct through the charging device can be reduced to about 5–25%, at most, of the amount of gas used for conveying the powder. Consequently, with regard to the regulation of the powder pattern at the ejection port 20, a method similar to that employed in the prior art electrostatic powder gun can be utilized. Therefore, an electrostatic powder painting gun having a highly excellent performance which was not found in the prior art gun and which can form a sufficiently uniform powder layer in a recessed portion of a body to be painted by overcoming the Faraday cage effect can be easily constructed in a very simple manner.

In this connection, with regard to the means for regulating an ejection pattern of a powder cloud in the proximity of the outlet end of the powder conveying duct, the means should not be limited only to the system employing a pattern regulating cone as shown in FIG. 3, since various well-known systems could be utilized such as a system in which, in addition to the outwardly flared ejection port, a separately introduced swirl flow is employed, or a system in which, in addition to the provision of a cone at the center of an ejection port 20, a swirl flow is also introduced. Moreover, with regard to the means for preventing the powder from adhering to the surface opposed to the body to be painted, that is the tip end portion of the cone 21 disposed at the ejection port, a system could be employed in which a small cylindrical recess is formed at the center of the surface of the cone opposed to the body to be painted and, by introducing a swirl flow into this recess, a strong gas stream flowing outwardly along the surface of the cone opposed to the body to be painted is established. Thereby adhesion of the powder to the surface of the cone opposed to the body to be painted can be prevented (See FIG. 8). Or else, for the purpose of regulating the ejection pattern of the cone, a system can be employed in which the relative positioning between the cone 21 and the ejection end 28 of the duct is made adjustable in the axial direction. It is to be noted that while only the powder charging device of the type shown in the left half of FIG. 2, among the powder charging devices illustrated in FIGS. 1 and 2, was shown in FIG. 3 for simplicity of illustration, as a matter of course, the powder charging device shown in FIG. 1 or in the right half of FIG. 2 or a combination of these powder charging devices, could be arbitrarily employed.

Figure 4:
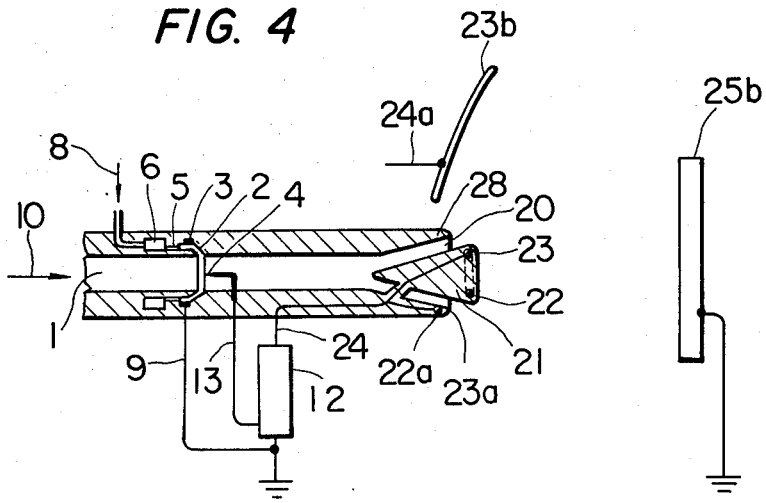

A device shown in FIG. 4 is an electrostatic powder painting gun which makes use of a powder charging device according to the present invention and makes it possible to effectively practice electrostatic powder painting at a room temperature above the temperature of a body to be painted having a high electric resistance such as glass products, plastics products, etc., in which powder is ejected from an ejection port 20 is a fully charged condition while being directed to a body **25*b* to be painted and regulated in an appropriate pattern by means of a pattern regulating cone 21. In this case, as the means merely for forming a strong electric field from the proximity of the ejection port 20 towards the body 25*b* to be painted, provided an electric field forming electrode 22 having a large radius of curvature in cross-section is provided at a short distance from the surface of the ejection pattern regulating cone 21 which has the function of dispersing the powder flow opposed to the body 25*b* to be painted. To this electrode 22 is applied a sufficiently high voltage from a voltage source 12 through a lead wire 24. In addition, this electrode 22 for forming an electric field can be disposed not only in the ejection pattern regulating cone 21 as described above, but also as an electrode 22*a* on the inside of an ejection end portion 28 of the ejection port 20 as shown in FIG. 4. Or else, besides the aforementioned two examples of the electric field forming electrodes 22 and 22*a*, an electric field forming electrode can be provided by disposing a separate field forming electrode 23*b* and applying a predetermined potential to this electrode 23*b* through a lead wire 24*a***.

Figure 5:
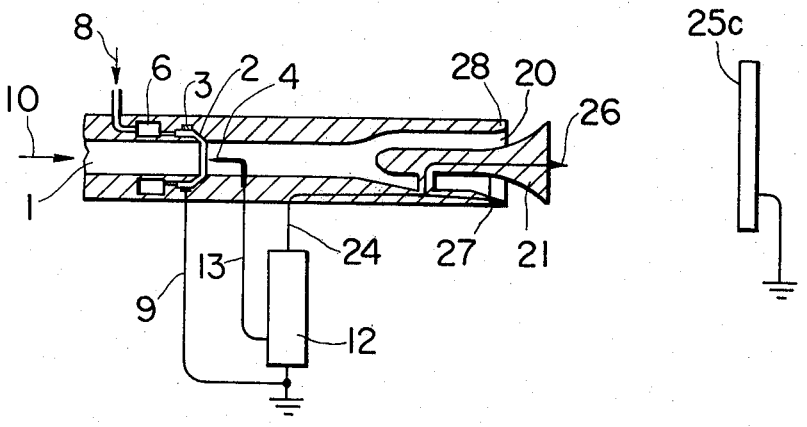

A novel type of electrostatic powder painting device having an extremely high painting efficiency can be constructed by combining the powder charging device according to the present invention with the prior art electrostatic powder painting gun in which a corona discharge electrode to which is applied a high voltage is disposed in the proximity of the powder ejection port facing a body to be painted. A preferred embodiment of the present invention of the above-described type is shown in FIG. 5. More particularly, in one type of prior art electrostatic powder painting gun in which a corona discharge pin 26 or a sharp-edged, annular electrode 27 for generating a corona discharge is disposed in the proximity of the ejection port 20 for powder suspended in gas facing a grounded body **25*c* to be painted and further a pattern regulating member 21 for the ejected powder is added to ejection port 20, there is additionally disposed on the upstream side of the gun, a powder charging device according to the present invention comprising a corona discharge electrode 4, an electrode chamber 2, a ring electrode 3, an annular chamber 6 and means for supplying clean gas as indicated by arrow 8. Owing to the above-mentioned construction, powder 10 conveyed by gas as suspended therein, is strongly charged unipolarly already when it passes through the powder charging device according to the present invention, so that at the ejection port 20 the powder 10 is subjected to charging caused by an ion current generated by the corona discharge existing between the ejection port and the body to be painted due to the action of the corona discharge electrode 26. It is also driven towards the body to be painted by an electric field existing between the ejection port and the body to be painted. Although the improvement depends, in practice, upon the kind of the body to be painted as used conventionally and the operating condition, in the system shown in FIG. 5 in which the powder charging device according to the present invention is utilized as a precharging device, normally the powder transfer efficiency can be improved by 5% to 15% as compared to the case where such a precharging device is not present, and this must be said to be a remarkable improvement in an electrostatic powder painting device. In addition, in the preferred embodiment shown in FIG. 5, a voltage source for applying a voltage to the powder charging device and a voltage source for applying a voltage to a corona discharge electrode 26 and/or a sharp-edge annular electrode 27 facing the body to be painted can be provided together. Furthermore, since the powder charging device according to the present invention is quite compact and since the amount of the auxiliary gas 8** to be used is very small, there is no difficulty in its use in combination with the prior art gun, and it is possible to provide the voltage sources in common and to use the auxiliary gas in common as cleaning gas for a needle electrode disposed in the proximity of the ejection port or as gas for regulating an ejection pattern. Therefore, this electrostatic powder painting gun according to the novel system has very large practical usefulness. With regard to the means for regulating a pattern of a powder cloud which is to be disposed in the powder ejection port at the position opposed to the body to be painted, every pattern regulating member can be utilized whether it is referred to in the above description or not, and also with respect to the type of the electrode, as a matter of course, every type of electrode can be utilized.

The unipolar powder charging device according to the present invention can create an electrostatic powder painting gun having a high transfer efficiency by disposing the powder charging device at a powder ejection port so that a corona discharge electrode may be opposed to a body to be painted. The details of such an electrostatic powder painting gun are illustrated in FIG. 6.

Figure 6:
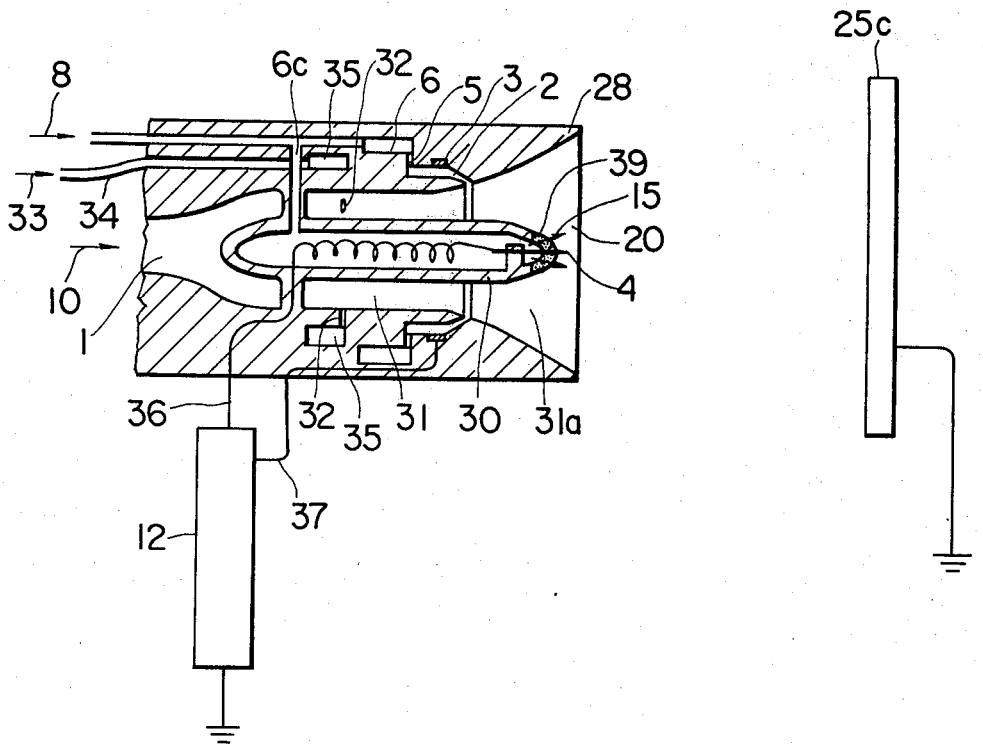

Referring now to FIG. 6, powder particles, conveyed by gas as suspended therein which are indicated by arrow 10, pass through an annular passageway 31 formed by a central member 30 disposed in the proximity of an ejection port coaxial therewith, then pass through an outwardly flared portion 31*a* and are ejected towards a body 25*c* to be painted. Then, gas introduced into an annular chamber 35 through piping 34 which is indicated by arrow 33, is blown from the annular chamber 35 through orifices 32 into the annular passageway 31 so as to have at least a flow component in the circumferential direction, so that the powder particles passing through the annular passageway 31 are swirled strongly in this portion so as to have a circumferential flow component, and thus it becomes possible to form an appropriate ejection pattern dependent upon the intensity of the gas flow when the powder particles are ejected from the outwardly flared portion 31*a*. In addition, at the tip end of the central member 30 a corona discharge electrode 4 is disposed according to the present invention, a ring electrode 3 is accommodated within an electrode chamber 2 which opens at the outwardly flared portion 31*a* through a slit, and clean gas indicated by arrow 8 is adapted to be ejected from the annular chamber 6 through a flow rate regulating device 5 along the entire inner circumference of the outwardly flared portion 31*a* and the ring electrode chamber 2. In this case, if necessary, it is possible to make the flow rate regulating device 5 also play the role of regulating the ejection pattern by making the gas ejected into the outwardly flared portion 31*a* of the annular passageway 31 through the flow rate regulating device 5 and the electrode chamber 2 have a flow component in the circumferential direction. The highest voltage is applied to the corona discharge electrode 4 from a voltage source 12 through a lead wire 36 and a voltage having a potential difference of several thousand to thirty thousand volts with respect to the corona discharge electrode is applied to the ring electrode 3 from the same voltage source 12 through a lead wire 37.

With the aforementioned construction, since a strong unipolar ion current film is established from the tip end of the corona discharge electrode 4 towards the ring electrode 3, the powder particles ejected from the ejection port 20, after having passed through the ion current film, are with certainty charged with a unipolar electric charge. At the same time, a strong electric field is established from the tip end of the corona discharge electrode 4 towards the body 25*c* to be painted, and simultaneously a corona discharge current is formed. Moreover, since the unipolar corona discharge current issuing from the tip end of the needle corona discharge electrode 4 towards the body to be painted has a far faster speed of movement than the powder particles and hence it reaches the body to be painted while quickly expanding from the tip end of the acicular electrode 4, the particles which have been preliminarily strongly charged by the unipolar corona discharge current flowing from the tip end of the corona discharge electrode 4 towards the ring electrode 3, are further strongly charged by the corona discharge which issues from the center of the powder flow towards the body to be painted and immediately and fully diffuse. They are also strongly driven by the electric field established from the corona discharge electrode 4 towards the body to be painted, so that an extremely high transfer efficiency can be obtained. Thus, by constructing an electrostatic powder painting gun in the above-described manner, one can provide a new type of electrostatic powder painting gun having an extremely high painting efficiency in which a powder charging device according to the present invention is incorporated in the gun head. It is to be noted that in the preferred embodiment shown in FIG. 6, that portion of the central member around the corona discharge electrode 4 provided at the tip end of the central member 30 is made of a gas-permeable material so that a portion of the introduced gas indicated by arrow 8 may be continuously ejected through a passageway 6*c* in a manner to wrap around the corona discharge electrode 4 as indicated by arrows 15.

By the aforementioned provision, accidents caused by adhesion and welding of powder particles to the corona discharge electrode 4 can be sufficiently prevented. In the case of such type of discharge electrode, the corona discharge current is different from that of the conventional type of electrostatic powder painting gun in that the current issuing from the tip end of the corona discharge electrode 4 is several times as large as the current flowing towards the body to be painted and most of the current flows towards the ring electrode 3, so that it becomes difficult for the powder particles to approach the tip end of the corona discharge electrode due to the existence of this strong ion current, and in addition, even in the case where the voltage applied to the corona discharge electrode is relatively low, it is certain that a corona discharge can be generated, and accordingly, the aforementioned embodiment has a characteristic merit that accidents caused by accumulation and welding of powder to the tip end of the acicular corona discharge electrode can be essentially reduced.

The electrostatic powder painting device according to the present invention of the type described in detail above with reference to FIG. 6, can achieve enhancement of transfer efficiency of 5–15% as compared with the conventional electrostatic powder painting device, and this is a significant improvement in electrostatic powder painting devices. It is to be noted that with respect to reference numerals for electrodes and other component parts in FIG. 6, components parts having basically the same functions as those shown in FIGS. 1 and 2 are given like reference numerals.

In the electrostatic powder painting device described above with reference to FIG. 6, with regard to the configuration of the powder ejection port and the means for regulating the ejection pattern, besides those illustrated in FIG. 6, every configuration of an ejection port and every means for regulating an ejection pattern which have been utilized in the heretofore known electrostatic powder painting devices can be employed, and for instance, a coaxially disposed pattern regulating cone such as illustrated in FIGS. 3, 4 and 5 can be, of course, utilized. With regard to the corona discharge electrode, too, it is a matter of course that the mode of embodiment is not limited only to that shown in FIG. 6. For instance, it is possible to provide another corona discharge electrode at the upstream end of the central member 30 so as to form the construction shown in the left half of FIG. 2, and as a matter of course, the central member 30 need not be so large in diameter as shown in FIG. 6. Instead in some cases a thin sheath-like member wrapping round the corona discharge electrode as shown in FIGS. 1 and 2 can be utilized.

Figure 7:
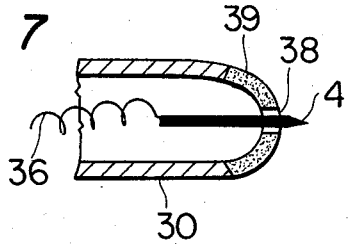

In addition, the means for preventing powder particles from adhering or welding to the tip end of the discharge electrode is also not limited only to that shown in FIG. 6, but for example, it is possible to achieve stabilization of the performance of the corona discharge electrode and to prevent accumulation of the powder particles to the corona discharge electrode by providing a narrow annular gap clearance 38 between the corona discharge electrode 4 and the central member surrounding the corona discharge electrode 4 as shown in FIG. 7. Moreover, in the case where it is necessary that the central member 30 have a large diameter, prevention of adhesion and welding of powder to the tip end of the central member 30 as well as prevention of accumulation of powder to the corona discharge electrode both can be achieved by not only providing the annular gap clearance 38 surrounding the tip end of the needle corona discharge electrode but also forming a part of the tip end of the central member 30 with a porous material 39 as shown in FIG. 7. It is to be noted that reference numeral 36 in FIG. 7 designates a lead wire for applying a voltage to the corona discharge electrode.

Figure 8:
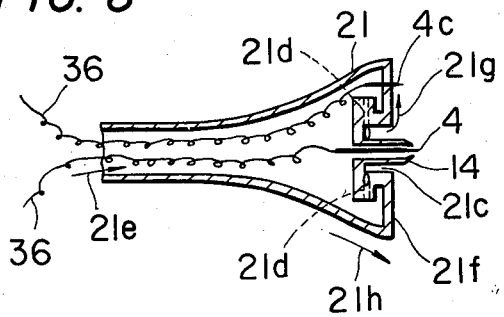
Figure 9:
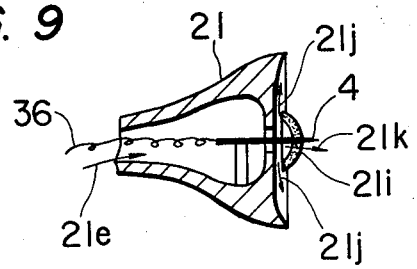

With regard to a preferred embodiment of the present invention in which an ejection pattern regulating cone 21 disposed coaxially in an ejection port is employed as means for regulating an ejection pattern of a powder cloud and a corona discharge electrode as shown in the first preferred embodiment illustrated in FIG. 1 is disposed in this ejection pattern regulating cone 21, basically the configuration shown in FIG. 5 could be employed, and alternative embodiments of the ejection pattern regulating cone 21 are illustrated in more detail in FIGS. 8 and 9. In general, powder is liable to accumulate on a surface opposed to a body to be painted of an outwardly flared ejection regulating cone 21, and hence, in any event means for always removing the accumulated powder is necessitated. For that purpose, since the accumulation of the powder can be prevented, for example, by forming the surface opposed to the body to be painted of a gaspermeable porous plate and making clean gas discharge therethrough as shown in FIG. 3, the corona discharge electrode according to the present invention can be utilized in such manner that a single corona discharge electrode is disposed at the center of the dispersing cone member 21 shown in FIG. 3 or a plurality of corona discharge electrodes are disposed along its circumference.

In the method shown in FIG. 8, a substantially cylindrical recess **21*c* is provided at the center portion of an outwardly flared ejection regulating cone 21, and a gas flow indicated by arrow 21*e* is ejected in the circumferential direction through holes 21*c* against the cylindrical inner wall surface of this recess 21*c* causing a swirl flow. This swirl flow achieves the function of always maintaining the surface of the ejection regulating cone 21 at right angles to the axis of the corona discharge electrode 4 clean as shown by arrow 21*g*, while sweeping surface 21*f* of the cone 21** opposed to the body to be painted to keep it clean.

In this embodiment, the corona discharge electrode 4 can be positioned along the axis of the outwardly flared dispersing cone member 21 shown in FIG. 8, and in such a case sometimes it is preferable to provide a sheath 14 made of an insulator material surrounding the corona discharge electrode 4 for simultaneously forming a gas flow wraping round the tip end of the corona discharge electrode 4. In addition, by disposing a plurality of corona discharge electrodes **4*c* coaxially with the outwardly flared dispersing cone member 21 which forms one preferred embodiment of the ejection pattern regulating cone so that the tip ends of the electrodes 4*c* may project a short distance, the cone member 21 can be utilized for regulating the pattern of the powder flow indicated by arrow 21*h* and simultaneously maintain stable corona discharge while keeping the tip ends of the corona discharge electrodes 4*c* always clean by means of the gas flow indicated by arrow 21*g***. This arrangement is quite useful as one preferred embodiment of the present invention.

Another method for preventing accumulation of powder on the surface opposed to the body to be painted of the outwardly flared dispersing cone member 21 disposed coaxially with the ejection port and also for preventing accumulation and welding of powder on the corona discharge electrode according to the present invention, is illustrated in FIG. 9. With reference to FIG. 9, around a corona discharge electrode 4 provided at the center of a dispersing cone member 21 an inverse cupshaped porous cap **21*i* is disposed to surround the corona discharge electrode 4, and this porous cap 21*i* is spaced a minute gap distance from the surface opposed to the body to be painted of the dispersing cone member 21. Through this gap space a clean gas flow 21*j* is caused to flow radially along the surface of the cone member 21 opposed to the body to be painted, and thus the clean gas introduced into the dispersing cone 21 as indicated by arrow 21*e* is divided into a gas flow indicated by arrow 21*k* which is ejected through the inverse cupshaped porous cap 21*i* made of a gas permeable porous material and the above-mentioned gas flow 21*j*, to achieve the functions of keeping the periphery of the needle corona discharge electrode and the surface of the dispersing cone member 21** opposed to the body to be painted clean and regulating the ejection pattern. In any event, in the case where the device according to the present invention is employed as an electrostatic powder painting device for achieving uniform, smooth and grainless high-class painting, it is a quite important objective to provide means for preventing accumulation of powder on the tip end and in the proximity of the corona discharge electrode disposed in an opposite relation to the body to be painted.

In the embodiment shown in FIG. 6, it is possible to provide an electrode having a large radius of curvature in cross-section for forming an electric field for driving charged powder particles toward a body to be painted in the ejection end portion 28 of the powder ejection port 20, and for this modified embodiment of the invention the system represented by the electrodes 22*a* and 23*a* in FIG. 4 can be employed by itself. In this modified embodiment, while voltages could be applied to the respective electrodes independently of each other, the voltage applied to the needle corona discharge electrode 4 could be in itself applied to these field forming electrodes. In the electrostatic powder painting device provided with the powder charging device according to the present invention at its ejection port as described in detail above with reference to FIGS. 6, 7, 8 and 9, it is, as a matter of course, that there must be provided means for prohibiting generation of a dangerous spark discharge extending from the field forming electrode to the body to be painted or a dangerous spark discharge occurring between the corona discharge electrode and the strip electrode such as by making a voltage source have voltage-drop characteristics suitable for safety of the device or by disposing a protective resistor having a sufficiently high resistance just before the electrode. In the drawings, these safety measures are all omitted from illustration.

Figure 10:
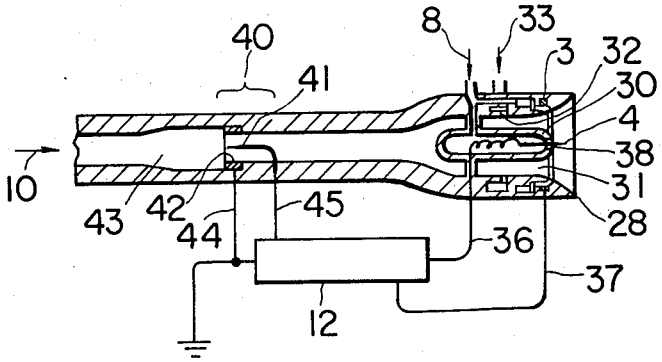

In an electrostatic powder painting device of the type in which the powder charging device according to the first preferred embodiment of the present invention shown in FIG. 1 is disposed in the proximity of the powder ejection port and the corona discharge electrode in the powder charging device is opposed to the body to be painted, since corona discharge occurs from the corona discharge electrode towards the body to be painted and at the same time a strong unipolar corona discharge current is present from the tip end of the corona discharge electrode towards the ring electrode, the powder particles ejected from the ejection port of the painting device can be very strongly charged. Thus, it is possible to achieve a high painting efficiency. However, in the case where an amount of powder ejected from one powder painting device is extremely large, then even with the aforementioned provision, charging will become insufficient, and will result in lowering of a transfer efficiency. In such cases, the problem can be effectively resolved by additionally disposing on the upstream side another powder charging device as shown in FIG. 10 which can charge the powder in the same polarity as the powder charging device according to the present invention disposed in the powder ejection port. In this figure, the construction of the powder charging device disposed in the proximity of the outlet of the electrostatic powder painting device is exactly the same as that shown in FIG. 6, and in these figures component parts having equivalent functions are given like reference numerals. On the other hand, with regard to a unipolar powder charging device 40 to be disposed on the upstream side, as a matter of course, the powder charging device according to the present invention as described above can be equally well employed, and as a corona discharge electrode, an electrode of the type shown in the left half of FIG. 2 could be provided on the upstream side of the central member 30, while a ring electrode opposed to the additional corona discharge electrode could be provided on the side of the cylindrical body of the duct. However, the unipolar powder charging device employed on the upstream side is not limited only to the unipolar powder charging device according to the present invention. One example is shown in FIG. 10 employing unipolar powder charging device that was previously proposed by the inventor of this invention and that which comprises an annular electrode 42 disposed in the proximity of the upstream end of a smaller-diameter cylindrical flow path, a needle electrode 41 disposed coaxially with and opposed to said annular electrode 42, a larger-diameter cylindrical flow path 40 contiguously connected to the upstream of said annular electrode 42, and lead wires 44 and 45 for applying a D.C. voltage between said respective electrodes.

In the above-mentioned construction, powder resin conveyed by gas represented by arrow 10 is preliminarily charged to a certain extent in the charging device 40. Thereafter it first traverses a unipolar corona discharge current layer extending from the tip end of the corona discharge electrode 4 towards the ring electrode 3 in the powder ejection port. It is also subjected to further charging by an ion current formed from the tip end of the corona discharge electrode 4 towards the body to be painted, and hence an extremely high transfer efficiency can be achieved even in the case where the ejection rate of the powder is very large.

It has been already described that sometimes the performance of the powder charging device according to the present invention can be further improved by regulating the humidity of the gas introduced into the device for the purpose of keeping the surface of the ring electrode clean, and it is already well known that the process of powder painting is generally largely affected by the humidity of the atmosphere in which the powder painting work is effected. More particularly, in the case of electrostatically painting with powder paint having an extremely high bulk electric resistance such as polyolefine series, fluorine resin series or epoxy resin series powder, if the humidity of the atmosphere in which the painting is effected is low, then a potential gradient in the powder layer applied to the body to be painted increases quickly as the discharge current of the powder painting gun increases, so that a thick film hardly can be obtained. At the same time it becomes difficult to obtain a smooth film of paint due to generation of inverse ionization, and the transfer efficiency also tends to be lowered. On the contrary, in some kinds of powder painting guns in the prior art, in the case where the humidity of the space where the painting is effected is too high, a tendency to a lowered transfer efficiency appears to be due to the fact that the discharge generated towards the body to be painted in suppressed by the moisture in the air and thus a sufficient discharge current cannot be obtained so that sufficient charging of the powder cannot be effected. Of course, the problem can be resolved by regulating the entire atmosphere in which the painting is carried out to have a proper humidity, but the expense required for practicing such a measure often becomes excessively large and it becomes difficult to practice. In such a case, in the powder charging device or the electrostatic powder painting device according to the present invention, the humidity only in the space where the powder travels towards the body to be painted can be regulated at a proper value by regulating to the proper humidity the auxiliary air used for the purpose of preventing adhesion and welding of powder to the respective electrodes and/or the auxiliary air used for the purpose of regulating the ejection pattern, and thereby the aforementioned problems can be resolved effectively. In addition, in the case of materials where moisture is hardly absorbed on the surface of the powder particles as is the case with polyolefine series powder, fluorine resin series powder, etc. and thus no problem is caused in the conveyance of the powder by humidifying up to an appropriate humidity the powder conveying air itself, then the humidity of the powder conveying air itself could be regulated.

Some representative examples of the method of applying voltages to the respective electrode in the powder charging device or electrostatic powder painting device according to the present invention, are illustrated in FIGS. 11, 12, 13 and 14. In these figures, only electrical circuit connections relating to the respective electrodes are shown, but the mechanical structure as well as items relating to the supply of the powder and gas are all omitted from the illustrations.

Figure 11:
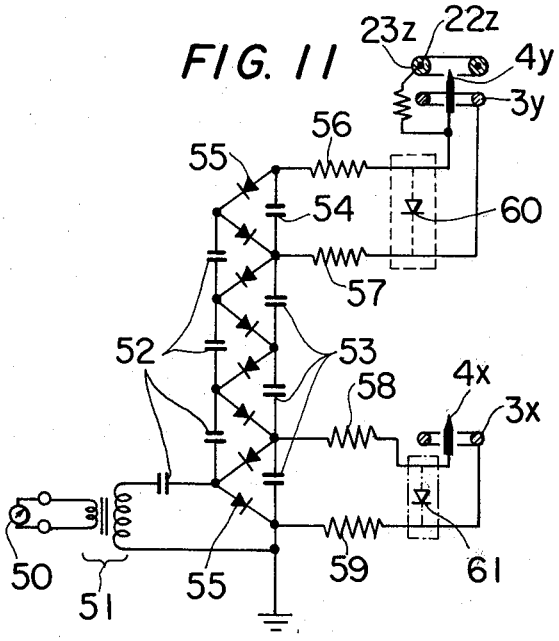

In FIG. 11, an electrode pair consisting of a corona discharge electrode 4*x* and a ring electrode 3*x* represents the case where the electrodes having the structure shown in FIG. 1 are employed as the precharging device 40 in FIG. 10, a corona discharge electrode 4*y* and a ring electrode 3*y* correspond, respectively, to the corona discharge electrode 4 and the ring electrode 3 disposed in the proximity of the powder ejection port in FIG. 10, and further as electric field forming electrode 22*z* having a substantially large radius of curvature and provided with a coating 23*z* of insulating material represents electric field forming electrodes as shown at 22*a* and 23*a* in FIG. 4 and a coating made of a semiconductor or an insulator material for preventing spark discharge on their surfaces, which are to be additionally disposed in the ejection port 28 at the tip end of the powder painting gun in FIG. 10, although it is not shown in FIG. 10. FIG. 11 shows one example of the means of application of voltages to the respective electrodes in the above-mentioned case. In FIG. 11, the voltage source forms, as a whole, the well-known Cockeroft-Walton type, high-frequency, multi-stage voltage-doubler, rectifier circuit consisting of a combination of capacitors 52, 53 and 54 and rectifiers 55. To this circuit is applied a high-frequency voltage from a high-frequency voltage source 50 via a transformer 51. The high-frequency voltage is stepped up by the action of these capacitors and rectifiers to generate successively higher voltages at the respective stages, and at the final stage the highest voltage is obtained. With reference to FIG. 11, to the corona discharge electrode 4*x* forming the precharging device a higher voltage on the capacitor 53 in the first stage of the illustrated multi-stage voltage-doubler rectifier circuit is applied by a guard resistor 58, while the ring electrode 3*x* in the same precharging device is connected to the grounded terminal of the first stage capacitor 53 in the voltage-doubler rectifier circuit by a guard resistor 59, and the geometrical configuration of the electrodes, resistances of the guard resistors 58 and 59, the parameters of the circuit elements in the multi-stage voltage-doubler rectifier circuit, the voltage of the high-frequency voltage source 50 and the characteristics of the coupling transformer 51 in the combination are determined so that an appropriate unipolar corona discharge current may flow from the corona discharge electrode 4*x* to the ring electrode 3*x* in response to the applied voltage. Likewise, to the corona discharge electrode 4*y* which serves both as a corona discharge electrode opposed to a body to be painted and as a powder charging device on the outlet side in an electrostatic powder painting device, and to the ring electrode 3*y*, are applied to the voltage generated at the opposite ends of the last storage capacitor 54 in the multi-stage voltage-doubler rectifier circuit by guard resistors 56 and 57, respectively, and the parameters of the respective circuit elements and the geometrical configuration of the electrodes are selected so that a unipolar ion current having an appropriate magnitude for charging the powder may be formed from the tip end of the corona discharge electrode 4*y* towards the ring electrode 3*y* and at the same time a desired unipolar corona discharge current may be established from the tip end of the corona discharge electrode 4*y* towards the body to be painted.

In this case it is a common practice to form the device so that the corona discharge current flowing towards the body to be painted and the voltage applied to the corona discharge electrode 4*y* relative to the ground are made adjustable, depending upon the properties of the powder, humidity of the painting space and distance between the corona discharge electrode 4*y* and the body to be painted. This can be achieved normally by making the voltage of the high-frequency voltage source 50 adjustable. In this case, the powder charging voltages applied between the two electrode pairs 4*x*–3*x* and 4*y*–3*y* are varied in proportion to each other by regulating the voltage of the voltage source 50, but it is possible to construct the entire device so that the powder charging effect may be achieved in a sufficiently stable manner during a certain amount of adjustment and variation of the voltage of the voltage source 50 by appropriately selecting the geometrical configuration of the respective electrode pairs and the parameters of the circuit elements. However, in the case where it is required to adjust the voltage of the corona discharge electrode 4*y* opposed to the body to be painted over an extremely wide range, this problem can be easily resolved by inserting constant-voltage circuits 60 and 61 (encircled by a dotted line and a dash-dot line, respectively,) in front of the respective electrode pairs so that the voltages applied between the respective pairs of electrodes will not be affected by the adjustment of the voltage of the high-frequency voltage source 50. While these constant-voltage circuits can be realized by means of constant-voltage diodes, as schematically indicated in FIG. 11, the circuits are not limited to such construction. In addition, while these could be applied to the electrode 22*z* disposed at the tip end of the powder ejection port of the electrostatic powder painting device the same voltage as that applied to the corona discharge electrode 4*y* through a conventional guard resistor as shown in FIG. 11, depending upon the object of use, a voltage higher than that applied to the corona discharge electrode 4*y* could be applied thereto by adding a further stage to the multi-stage voltage-doubler rectifier circuit and deriving the higher voltage from the additional stage. As described above, various modifications could be made in the above-described D.C. high voltage source.

Figure 12:
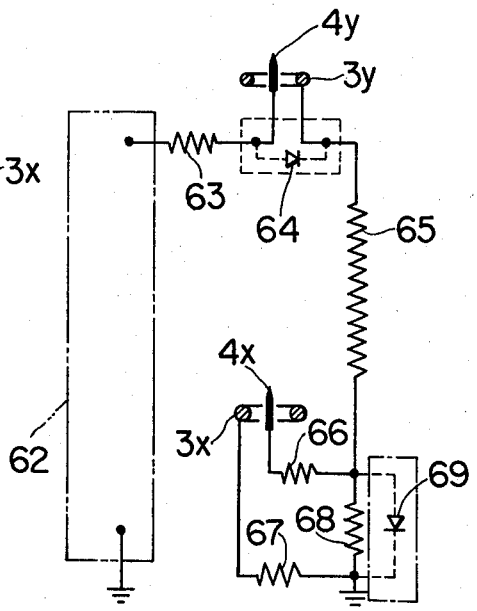

Another method for applying voltages to two sets of electrodes having the same construction as those illustrated in FIG. 11 for achieving the desired functions, is shown in FIG. 12. With reference to FIG. 12, the highest voltage in the voltage source 62, represented by a frame of a double-dot chain line, is applied from the voltage source 62 to a corona discharge electrode 4*y* through a guard resistor 63. In this arrangement, as the voltage source 62, a multi-stage voltage-doubler rectifier circuit as shown in FIG. 11 could be employed, and besides, any other appropriate voltage source having a desired voltage and a desired current capacity could be used therefor.

Between a ring electrode 3*y* which is paired with the corona discharge electrode 4*y* and the ground are connected load resistors 65 and 68, and the resistances of these resistors are chosen so that the unipolar corona discharge current flowing from the corona discharge electrode 4*y* to the ring electrode 3*y* takes an appropriate value. In this case, although a corona discharge current normally flows also from the corona discharge electrode 4*y* towards the body to be painted and this current varies widely depending upon the distance between the body to be painted and the corona discharge electrode and other conditions, the current for charging the powder would be scarcely affected by the variation of the current flowing towards the body to be painted because the distance between the corona discharge electrode 4*y* and the ring electrode 3*y* is far smaller than the distance between the tip end of the corona discharge electrode and the body to be painted. Then, powder suspended in gas flowing between the corona discharge electrode 4*y* and the ring electrode 3*y*, and the humidity and powder concentration in that gas will vary over a substantially wide range depending upon the operating conditions. However, the influence of these factors affecting the unipolar ion current flowing between these electrodes has a complementary relation to the potential difference between the ring electrode 3*y* and the corona discharge electrode 4*y* which potential difference is determined by the load resistor 65, and therefore, the method for applying voltages to the respective electrodes illustrated in FIG. 12 can achieve a sufficiently stable performance of the electrode substantially without being affected by the powder concentration in the gas passing between the respective electrodes, the distance between the corona discharge electrode and the body to be painted, or the humidity of the gas conveying the powder. In addition, the voltage generated by the corona discharge current flowing from the ring electrode 3*y* towards the ground potential is divided by the combination of the load resistors 65 and 68, and the voltage appearing across the resistor 68 is applied between the corona discharge electrodes 4*x* and 3*x* forming the precharging device via guard resistors 66 and 67. Thereby a stable unipolar corona discharge current can be obtained between the precharging electrodes 4*x* and 3*x* without applying a voltage therebetween by employing an especially active voltage source. This method for applying voltages is simple in structure, is easy in switching a dividing ratio of resistors, and is available at less expense. It is a matter of course that in some cases a preferable result can be obtained by making use of applied voltage stabilizer means 64 and 69 between the respective pairs of electrodes.

In the above, description has been made with respect to the type of voltage supply circuits in which guard resistors 56, 57, 58, 59, 63, 66, 67, etc. are always inserted in the lead wires for applying voltages to the respective electrodes just before the electrodes for the purpose of preventing spark discharge or securing safety of a human body. However, these guard resistors are not always necessary in the case where the electrostatic capacity of the electrode itself with respect to the ground is very small and the lead wire connecting the electrode to the voltage source is extremely short.

For the aforementioned reasons, in many cases it is desirable to compactly construct the high voltage generating source, for instance, the high-frequency multi-stage voltage-double rectifier circuit consisting of capacitors and rectifiers as shown in FIG. 11 or the voltage source 62 in FIG. 12, and to mount it on the gun body. In this case, only the high-frequency multi-stage voltage-doubler rectifier circuit could be mounted on the gun body, or else, additionally the step-up transformer 51 in FIG. 11, for example, could also be mounted on the gun body. Furthermore, various modes of embodiment of the present invention could be made such that a D.C. voltage is applied to the gun body after the D.C. voltage has been converted into a high-frequency voltage by means of an inverter, the voltage doubler rectifier circuit is actuated by the high-frequency voltage. This is also true with respect to the voltage source 62 in FIG. 12, and in some cases it is desirable to assemble the load resistors 65 and 68. It is to be noted that of course, the polarity of the voltages used in the powder charging device and electrostatic powder painting device according to the present invention could be selected appropriately to be either positive or negative depending upon the properties of the powder. Switching of the polarity can be done easily by constructing the voltage source illustrated in FIG. 11, 12, 13 or 14 as an easily attachable and detachable structure and mounting it on the gun body, and thereby convenience of the user can be realized. Moreover, by employing the above-mentioned system, manufacture of a gun body and manufacture of a voltage source can be separated, and this produces various merits in production control.

Furthermore, in many cases it is desirable to individually construct each electrode pair so that the respective electrode pairs can be easily and separately removed from the gun body and replaced for the purpose of maintenance and inspection.

Figure 13:
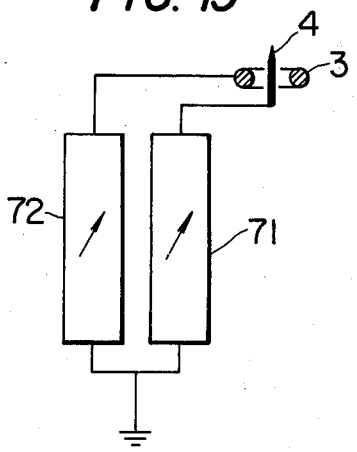
Figure 14:
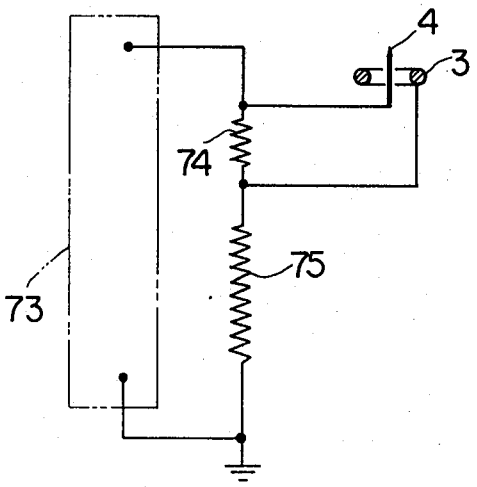

FIGS. 13 and 14 illustrate other methods for applying voltages to the electrode pair 4 and 3. In the system shown in FIG. 13, voltages are separately applied from separate voltage sources 71 and 72 to the corona discharge electrode 4 and the ring electrode 3, respectively. This system is convenient in that the voltage sources 71 and 72 are respectively constructed as variable voltage sources and thereby voltages suitable for the object of use can be applied to the respective electrodes depending upon requirements. In the case of this system also, the voltage source could be either arranged separately or mounted on the gun body, depending upon the object of use. FIG. 14 illustrates still another system in which a single high voltage generated by a voltage source 73 is divided by a combination of voltage-dividing resistors 74 and 75 for application to the corona discharge electrode 4 and the strip electrode 3, respectively. Besides, with respect to the system for applying voltages to the electrodes depending upon the characteristics of the electrodes and the object of use, of course, other conventionally known methods could be employed within the objective of the present invention.

What is claimed is:

1. A powder charging device characterized in that said device comprises a duct for conveying powder as suspended in gas, an annular electrode chamber positioned outside of said duct and communicating with said duct through a slit extending substantially along the entire inner circumference of said duct, a ring electrode disposed within said electrode chamber and having a substantially large radius of curvature in cross-section, a corona discharge electrode disposed at the center of said duct, means for introducing gas into said duct through said slit, and means for applying a voltage between said respective electrodes.

2. A powder charging device as claimed in claim 1, characterized in that said ring electrode is made of a non-adhesive conductive material.

3. A powder charging device as claimed in claim 1, characterized in that said ring electrode is made of conductive fluorine resin material.

4. A powder charging device as claimed in claim 1, characterized in that said corona discharge electrode is disposed with its tip end directed in the downstream direction of the powder flow.

5. A powder charging device as claimed in claim 4, characterized in that said device comprises means for ejecting gas which surrounds the tip end of said corona discharge electrode.

6. A powder charging device as claimed in claim 1, characterized in that said corona discharge electrode is disposed with its tip end directed upstream of the powder flow.

7. A powder charging device as claimed in claim 1, characterized in that said corona discharge electrode has a pair of tips, one on its downstream end and one on its upstream end with respect to the direction of powder flow, and these tip ends are held substantially at the same potential.

8. An electrostatic powder painting device comprising a duct for conveying powder as suspended in gas, an annular electrode chamber positioned outside of said duct and communicating with said duct through a slit extending substantially around the entire inner circumference of said duct, a ring electrode disposed within said electrode chamber and having a substantially large radius of curvature in cross-section, a corona discharge electrode disposed at the center of said duct, means for introducing gas into said duct through said slit, means for applying a voltage between said respective electrodes, and means disposed in the proximity of the outlet end of said duct for conveying said powder for regulating the ejection pattern of a powder cloud.

9. An electrostatic powder painting device as claimed in claim 8, characterized in that electrode means for establishing an electric field for driving charged powder towards a body to be painted is disposed in the proximity of the outlet end of said duct for conveying powder.

10. An electrostatic powder painting device as claimed in claim 9, characterized in that at least a part of said electrode means for establishing an electric field is an electrode having a large radius of curvature that is mounted in said outlet end of said means for regulating the ejection pattern.

11. An electrostatice powder painting device as claimed in claim 9, characterized in that said electrode means for establishing an electric field is a corona discharge electrode mounted in said outlet end of said means for regulating the ejection pattern.

12. An electrostatic powder painting device as claimed in claim 9, characterized in that at least a part of said electrode means for establishing an electric field constitutes a corona discharge electrode for generating unipolar corona discharge towards said ring electrode.

13. An electrostatic powder painting device as claimed in claim 9, characterized in that said electrode means for establishing an electric field includes a corona discharge electrode and an electric field forming electrode embedded in said outlet end and having a substantially large radius of curvature in cross-section, and to said electric field forming electrode is applied a voltage equal to or higher than a voltage applied to said corona discharge electrode.

14. An electrostatic powder painting device comprising a duct for conveying powder as suspended in gas, an annular electrode chamber positioned outside of said duct and communicating with said duct through a slit extending substantially around the entire inner circumference of said duct, a ring electrode disposed within said electrode chamber and having a substantially large radius of curvature in cross-section, a corona discharge electrode disposed at the center of said duct, means for introducing gas into said duct through said slit, means for applying a voltage between said respective electrodes, and means disposed in the proximity of the outlet end of said duct for conveying said powder for regulating the ejection pattern of a powder cloud; characterized in that there is provided a unipolar precharging device for charging the powder in the same polarity as said electrostatic powder painting device at the upstream end of said duct for conveying said powder.

15. An electrostatic powder painting device as claimed in claim 14, characterized in that said ring electrode is made of non-adhesive conductive material.

16. An electrostatic powder painting device as claimed in claim 14, characterized in that a unipolar powder charging device comprising an annular electrode disposed in the proximity of an upstream end of a smaller-diameter cylindrical flow path, a needle electrode disposed coaxially with said annular electrode as opposed thereto, and a larger-diameter cylindrical flow path continuously provided at the upstream of said annular electrode, and adapted to have a voltage applied between said respective electrode, is employed as said unipolar precharging device disposed at the upstream of said duct for conveying said powder.

17. An electrostatic powder painting device as claimed in claim 14, characterized in that said duct for conveying powder has as said means for regulating said ejection pattern an ejection port for introducing gas into said duct from an inner wall surface thereof so as to have a circumferential flow component in the proximity of the outlet end of said duct.

18. An electrostatic powder painting device as claimed in claim 17, characterized in that said duct for conveying powder comprises a guide piece that is coaxial with said duct so that said duct may have an annular cross-section of its inner space in the proximity of its outlet end.

19. An electrostatic powder painting device as claimed in claim 18, characterized in that said guide piece is provided with a corona discharge electrode at least at one of the outer and inner ends of said guide piece.

20. An electrostatic powder painting device as claimed in claim 14, characterized in that said duct for conveying powder is provided with a dispersing cone in the proximity of the outlet end thereof as said means for regulating an ejection pattern.

21. An electrostatic powder painting device as claimed in claim 20, characterized in that said device comprises means for forming a high speed gas flow along a surface of said dispersing cone opposed to a body to be painted.

22. An electrostatic powder painting device as claimed in claim 14, characterized in that said dispersing cone is provided with a corona discharge electrode integrally attached thereto.

23. An electrostatic powder painting device as claimed in claim 22, characterized in that said duct for conveying powder has a guide piece of which said dispersing cone forms a part.

24. An electrostatic powder painting device as claimed in claim 14, characterized in that a corona discharge electrode disposed in the proximity of the outlet and of said duct for conveying powder and is provided with means for ejecting gas which surrounds said corona discharge electrode.

25. An electrostatic powder painting device as claimed in claim 14, characterized in that at least a part of said duct for conveying powder proximity to the outlet end thereof is formed of a porous gas-permeable member, and there is provided conduit means for supplying gas to flow out through said porous gas-permeable member.

26. An electrostatic powder painting device as claimed in claim 14, characterized in that said means for applying a voltage between said respective electrodes, supplies said voltage from desired stages of a high-frequency multi-stage voltage doubler rectifier circuit.

27. An electrostatic powder painting device as claimed in claim 26, characterized in that means are provided for adjusting the range of the voltage of said voltage source and a constant voltage circuit between said source and said corona discharge electrode and said ring electrode for maintaining a substantially constant voltage between said respective electrodes over the adjustable range of the voltage of said voltage source.

28. An electrostatic powder painting device as claimed in claim 27, characterized in that said constant-voltage circuit includes a Zener diode which operates within the range where a constant-voltage property is presented.

29. An electrostatic powder painting device as claimed in claim 14, characterized in that said corona discharge electrode is connected to a voltage source, and said ring electrode is connected to a load resistor so that an appropriate potential difference may be established between said respective electrodes.

30. An electrostatic powder painting device as claimed in claim 14, characterized in that a voltage source and a voltage divider are provided and connected to both said corona discharge electrode and said ring electrode so that an appropriate potential difference may be established between said respective electrodes.

31. An electrostatic powder painting device as claimed in claim 14, characterized in that said corona discharge electrode and said ring electrode are respectively connected to separate voltage sources which are independent of each other.

* * * * *

UNITED STATES PATENT AND TRADEMARK OFFICE

CERTIFICATE OF CORRECTION

PATENT NO. : 4 289 278

DATED : September 15, 1981

INVENTOR(S) : Tsutomu Itoh

It is certified that error appears in the above—identified patent and that said Letters Patent is hereby corrected as shown below:

Column 2, line 7:

Delete "for" (first occurrence)

Column 3, line 40:

"insulative" should be --insulator--

Column 4, line 38:

Delete "further"

Column 4, line 43:

"electrodes" should be --electrode--

Column 5, line 48:

"varying" should be --applying--

Column 6, line 30:

Delete "flow" and insert --stream--

Column 6, line 52:

"m/sed." should be --m/sec.--

Column 7, lines 18 and 19:

Delete "the necessity"

UNITED STATES PATENT AND TRADEMARK OFFICE

CERTIFICATE OF CORRECTION

PATENT NO. : 4 289 278

DATED : September 15, 1981

INVENTOR(S) : Tsutomu Itoh

It is certified that error appears in the above—identified patent and that said Letters Patent is hereby corrected as shown below:

Column 8, line 6:

After "electrode" delete --,--

Column 8, line 7:

After "electrode" insert --,--

Column 12, line 6:

Delete "is" (second occurrence) and insert --in--

Column 15, line 49:

"to" should be --on--

Column 16, line 7:

"gaspermeable" should be --gas-permeable--

Column 16, line 56:

"cupshaped" should be --cup-shaped--

Column 19, line 37:

"as" should be --an--

UNITED STATES PATENT AND TRADEMARK OFFICE

CERTIFICATE OF CORRECTION

PATENT NO. : 4 289 278

DATED : September 15, 1981

INVENTOR(S) : Tsutomu Itoh

It is certified that error appears in the above—identified patent and that said Letters Patent is hereby corrected as shown below:

Column 20, line 12:

Delete "to" (second occurrence)

Column 20, line 13:

"storage" should be --stage--

Signed and Sealed this

*Thirteenth* Day of *April 1982*

[SEAL]

*Attest:*

GERALD J. MOSSINGHOFF

*Attesting Officer*

*Commissioner of Patents and Trademarks*